United States Patent [19]

Galaniuk

[11] Patent Number: 4,846,121

[45] Date of Patent: Jul. 11, 1989

[54] VARIABLE FRICTION ROLLER TAPPETS

[75] Inventor: Alexander H. Galaniuk, Dearborn, Mich.

[73] Assignee: Ford Motor Company, Dearborn, Mich.

[21] Appl. No.: 253,517

[22] Filed: Oct. 5, 1988

[51] Int. Cl.[4] ..... F01L 1/14

[52] U.S. Cl. ..... 123/90.48; 123/90.5

[58] Field of Search ..... 123/90.48, 90.5

[56] References Cited

U.S. PATENT DOCUMENTS

| | | | |
|---|---|---|---|
| 3,108,580 | 10/1963 | Crane | 123/90.5 |
| 4,607,599 | 8/1986 | Buente et al. | 123/90.5 |
| 4,747,376 | 5/1988 | Speil et al. | 123/90.5 |
| 4,771,741 | 9/1988 | Leer | 123/90.5 |
| 4,793,295 | 12/1988 | Downing | 123/90.5 |

*Primary Examiner*—Charles J. Myhre
*Assistant Examiner*—Weilun Lo
*Attorney, Agent, or Firm*—Clifford L. Sadler; Jerome R. Drouillard

[57] ABSTRACT

A tappet assembly for use in the valve train of an automotive type internal combustion engine has a roller at one end adapted to be engaged by the cam lobe of a camshaft for that engine. A spring biased piston is incorporated in the assembly for movement into frictional engagement with the roller at low engine speeds to dampen out vibrational or shaking forces present in the engine at this speed level by increasing the resistance to rotation of the roller. At higher engine speeds, the piston is moved progressively away from frictional contact with the roller by engine oil galley oil pressure, which increases with engine speed, to a point where the piston is completely removed from engagement with the roller and the roller is permitted to freely rotate at a point when the engine vibration or shaking forces are no longer present.

6 Claims, 1 Drawing Sheet

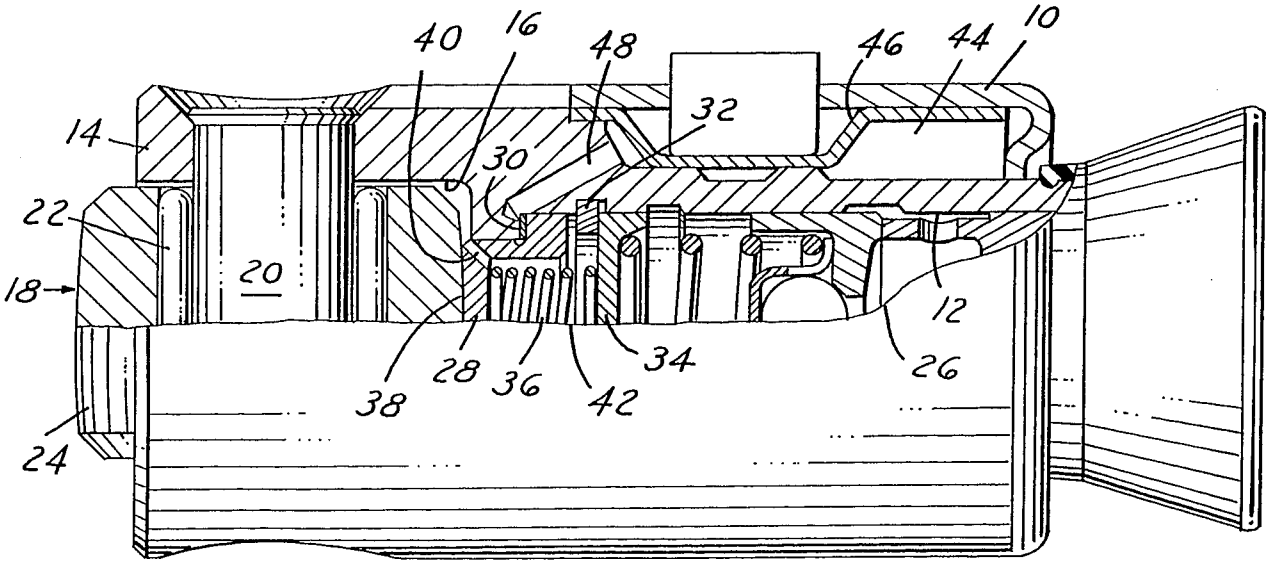
10
44
46
48
16
40
14
22
18
20
32
30
12
26
34
42
36
28
38
24

VARIABLE FRICTION ROLLER TAPPETS

This invention relates in general to a tappet assembly for use in the valve train of an automotive type internal combustion engine. More particularly, it relates to one in which a roller is incorporated in the tappet for engagement by the cam lobe of a conventional overhead camshaft, and means are provided to vary the frictional forces acting on the roller at lower engine speeds to dampen out engine vibration or shaking forces.

The efficiency of the modern four-stroke spark ignition engine can be improved by decreasing the high mechanical friction present in these engines. For example, the addition of a freely rotating roller to the tappet where it interfaces with the lobe of the camshaft to follow the cam lobe contour can be done with less internal energy wasted and consequently more output energy available.

However, due to less than ideal air/fuel delivery to the combustion chambers of some engines, the combustion forces at low engine speeds, such as at idle, can vary in intensity and manifest themselves in a non-uniform vibration or shaking of the total engine. In these engines, high internal friction sometimes is utilized to dampen out this unwelcome phenomena of vibration or shaking.

It is a primary object of the invention, therefore, to provide a roller tappet design wherein variable friction forces can be applied to the roller to offset the undesirable vibration or shaking forces at engine idle speeds, while returning the engine to a more efficient operating mode at the higher engine speeds. This is accomplished by the use of a variable friction roller tappet using engine oil galley oil pressure, which increases as a function of engine speed, to progressively decrease the frictional forces acting on the roller as engine speed increases.

The use of roller tappets and oil pressure or other similar means acting against the roller is known. For example, Rice. U.S. Pat. Nos. 1,977,778. Yingling, 2,385,959, Perr. 4,395,979, Essl, 2,346,737, and Van Ranst, 2,041,983 all show the use of rollers in one manner or another and the use of oil or liquid to constantly urge the roller against the cam lobe. However, this is all that the prior art shows. It does not show a variable friction roller tappet design that varies the frictional resistance to rotation of the roller as a function of engine speed by means of engine oil galley oil pressure.

It is another object of the invention, therefore, to provide a variable friction roller tappet consisting of a roller engaged by a movable piston that is spring biased against the roller at low engine speeds to increase the frictional resistance to rotation, while at higher engine speeds, the piston is progressively moved away from frictional contact with the roller to progressively decrease the resistance as the function of increases in the engine oil galley oil pressure.

Other objects, features and advantages of the invention will become more apparent upon reference to the succeeding, detailed description thereof, and to the drawing illustrating the preferred embodiment thereof wherein:

The single figure illustrates a cross-sectional view of one-half of a roller tappet assembly embodying the invention.

The figure in this case shows a tappet assembly including a cylindrical tappet body 10 having a stepped diameter central cavity 12 that extends longitudinally through the body, as shown. At its one end 14, the cavity has an enlarged area or recess 16 within which is mounted a roller assembly 18. The latter includes a shaft 20 fixed in the walls of the tappet body 10 at right angles to the body axis and an annulus of needle bearings 22 rotatably supporting a roller 24 for rotation in the recess. The lefthand end of the roller, as seen in the figure, would engage the convex surface of a cam lobe, not shown, of a conventional camshaft.

Mounted in cavity 12 coaxial with the axis 26 of the tappet body 10 is a hat-shaped-like piston member 28. The latter is axially slidable between a shoulder portion 30 of the tappet body and a ring stop member 32 engaged in an appropriate groove in the body. An annular spring retainer 34 serves as a seat for a light force spring 36 captured between the member 34 and the back face of piston 28. This will bias the piston into frictional contact or engagement on its front face 38 with the periphery of the roller 24. A vent passage 40 is provided to relieve any oil pressure in the spring chamber 42.

Radially outwardly of the central cavity 12 is a second chamber or cavity 44, defined also in part by an annular member 46. The chamber 44 is adapted to be connected to the engine oil system, and particularly to the engine oil gallery oil pressure system so that oil that increases in pressure with engine speed will be present in chamber 44. Chamber 44 is connected by an oil passage 48 diagonally to the front face of piston 28. Therefore, it will act against the piston with a force that increases as a function of the increase in oil pump pressure in chamber 44 so that the piston will be moved in a rightward direction, as viewed in the figure, against the force of spring 36 to decrease the frictional contact between the piston and roller 24. This will progressively decrease the resistance to rotation of the roller 24 as engine speed increases, which is the desired result since it is mainly at low engine idle speeds where the vibration or shaking forces pose a problem. At a predetermined pressure increase in the oil gallery, which is the pressure available in chamber 44, the piston will have moved rightwardly until it seats against the stop ring 32. This action will remove the piston from the roller at the contact area and permit the roller to rotate around its shaft 20 without friction applied to its peripheral surface 38.

The gallery oil pressure, and as a result, the oil in chamber 44, is governed mainly by engine RPM and engine oil pump characteristics, and generally is lower in the engine idle speed range than in the operating range. Consequently, the biasing spring 36 and piston oil pressure applying surface 30 and the oil pressure in the cavity 44 have to be balanced at an engine RPM which is above the idle engine RPM that effects a vibration or shaking.

The force of the piston 28 being applied at the contact area of the roller and the resulting restriction to the roller moving freely around its shaft should preferably be less than the frictional forces required for the roller to roll freely on the surface of the camshaft lobes. Otherwise, if the forces are greater than those frictional forces required for free rotation of the roller, the roller will not roll freely.

From the foregoing, it will be clear that the invention provides a roller tappet assembly in which resistance to rolling of the roller is variable and controlled by a piston moved by engine oil pressure to vary the rotational resistance as a function of engine speed so that at low engine speeds, a greater resistance to rotation is provided than at the higher engine speeds when the roller may be permitted to rotate freely.

While the invention has been shown and described in its preferred embodiment, it will be clear to those skilled in the arts to which it pertains that many changes and modifications may be made thereto without departing from the scope of the invention.

I claim:

1. A tappet assembly for use in the valve train of an automotive type internal combustion engine, comprising a longitudinally extending tappet body having a central cavity, a roller mounted in one end of the cavity for rotation about an axis at right angles to the longitudinal axis of the body, piston means movable against the roller periphery with a frictional engagement, spring means biasing the piston means against the roller, and means connecting engine oil pressure to the piston means to act thereon in opposition to the spring means to move the piston means away from the roller periphery thereby decreasing the force of the frictional engagement.

2. A method of controlling the frictional resistance to rotation of a roller engageable by a cam on the camshaft of an internal combustion engine, comprising the steps of biasing a piston into frictional engagement with the roller with a force less than the forces required for free rotation of the roller on the cam surfaces, and, secondly, applying engine oil pressure to the piston in a direction opposing the biasing force to reduce the frictional resistance to rotation as a function of the increase in engine oil pressure with increased engine RPM.

3. A tappet assembly including a tappet body having a central cavity rotatably receiving a roller therein, friction producing means biased against the roller to increase its resistance to rolling, and engine speed responsive means acting against the friction producing means at higher engine speeds in a direction to reduce the frictional contact therebetween to decrease the frictional resistance to rolling.

4. A tappet assembly as in claim 3, the friction increasing means comprising a pressure movable piston, spring means biasing the piston, the engine speed responsive means comprising engine oil.

5. A tappet assembly as in claim 4, the tappet body having a second cavity radially outward of the body cavity, the second cavity containing engine oil under pressure from the engine oil system that increases in pressure as a function of engine speed, and passage means connecting the engine oil to the piston means to act thereon.

6. A tappet assembly for use in the valve train of an automotive type internal combustion engine, comprising a longitudinally extending tappet body having a central cavity, a roller mounted for rotation in one end of the cavity on a shaft at right angles to the longitudinal axis of the cavity, piston means coaxially mounted on the cavity axis and movable against the roller periphery with a frictional engagement, spring means biasing the piston means against the roller, the body including a radially outer cavity containing engine oil galley oil under pressure that increases as a function of engine speed, and oil passage means connecting engine oil pressure to the side of the piston means adjacent to the roller to act thereon in opposition to the spring means to progressively move the piston means away from the roller periphery as a function of increases in oil pressure against the piston means thereby decreasing the force of the frictional engagement, and stop means in the path of movement of the piston means to limit the movement thereof, engagement of the stop means by the piston means removing the piston means from frictional contact with the roller permitting the roller to rotate freely.

* * * * *